US005199369A

United States Patent [19]

Meyer et al.

[11] Patent Number: 5,199,369

[45] Date of Patent: Apr. 6, 1993

[54] WATER TIGHT DOOR

[75] Inventors: Jeffry R. Meyer, Penn Hills Township, Allegheny County; Richard P. Kole, Murrysville; Kevin V. Bridge, Unity Township, Westmoreland County, all of Pa.

[73] Assignee: Westinghouse Electric Corp., Pittsburgh, Pa.

[21] Appl. No.: 859,274

[22] Filed: Mar. 26, 1992

Related U.S. Application Data

[63] Continuation of Ser. No. 669,541, Mar. 14, 1991, abandoned.

[51] Int. Cl.[5] ..... B63B 19/00

[52] U.S. Cl. ..... 114/117; 114/201 R

[58] Field of Search ..... 114/116, 117, 201 R, 114/203; 49/475, 480, 483, 485, 486, 496, 488–490; D8/330; D25/47, 48; 52/204, 213, 214; 220/221, 222, 224, 226, 315, 334, 344

[56] References Cited

U.S. PATENT DOCUMENTS

| | | | |
|---|---|---|---|
| 2,060,608 | 11/1936 | Butler | 114/117 |
| 2,101,550 | 12/1937 | Lambert | 114/117 |
| 2,128,305 | 8/1938 | Lambert | 114/117 |
| 2,156,635 | 5/1939 | Mascuch | 114/117 |
| 2,216,012 | 9/1940 | Jacob | 114/117 |
| 2,440,764 | 5/1948 | Wilson | 114/117 |
| 2,490,321 | 12/1949 | Perhach | 114/117 |
| 2,511,267 | 6/1950 | Jacob | 114/117 |
| 3,039,417 | 6/1962 | Hoffberg | 114/117 |
| 3,777,693 | 12/1973 | Leevers | 114/117 |
| 4,114,424 | 9/1978 | Johnson | 114/117 |

*Primary Examiner*—Joseph F. Peters, Jr.
*Assistant Examiner*—Clifford T. Bartz

[57] ABSTRACT

A water tight prehung door for a ship bulkhead, the door being formed from a plate with a peripheral band welded thereto, being stiffened by a plurality of channels extending from one side of the door to the other and having elongated dimples in the plate disposed between the channels; a double directional gasket which buckles when closed is contained in a partial enclosure and cooperates with a dogging mechanism utilizing a parallel bar linkage which moves rollers over wedge shaped lugs to dog the door closed and form a water tight seal irrespective of which side of the door is subjected to pressure.

10 Claims, 6 Drawing Sheets

WATER TIGHT DOOR

GOVERNMENT CONTRACT

This invention was conceived or first reduced to practice in the course of, or under contract number N00024-86-C-4030 between Westinghouse Electric Corporation and the United Stated Government, represented by the Department of the Navy.

CROSS REFERENCE TO RELATED APPLICATIONS

This application is a continuation of application Ser. No. 07/669,541 filed Mar. 14, 1991; now abandoned.

This application is related to co-pending applications entitled "Double Directional Gasket", U.S. Ser. No. 07/669,261 filed Mar. 14, 1991, now U.S. Pat. No. 5,112,065; issued May 12, 1992, and "A Dogging Mechanism", U.S. Ser. No. 07/669,258 filed Mar. 14, 1991.

BACKGROUND OF THE INVENTION

The invention relates to a water tight door and more particularly to a water tight bulkhead door on a ship.

Traditionally water tight bulkhead doors were heavy and utilized grooves or knife edges and flat gaskets to provide high pressure areas on the flat gaskets to provide an effective seal. A linkage type hinge or a slotted hinge assembly is used so the door can freely rotate to the closed position, at which time a lateral door movement is introduced by a dogging mechanism, pulling the entire door perimeter into simultaneous high pressure knife edge and gasket interaction. Consequently to seal the door requires that high closing forces be provided by a dogging mechanism, which includes heavy linkage that slide movable wedges over fixed wedges to create the lateral motion needed for sealing. Distortion of the doors and bulkheads created by such things as dynamic loading of the hull, improper door installation techniques and damage to the frame or door panel either increase the dog loading required to create a seal or form gaps between the knife edge and gasket so that watertightness is lost. The dogging mechanism is subjected to high frictional loads and rapid wear, resulting in frequent adjustment and leaking doors.

SUMMARY OF THE INVENTION

Among the objects of the invention may be noted the provision of a water tight, light weight door requiring low sealing forces that can be applied with little human effort.

In general, a water tight door, when made in accordance with this invention, comprises a door panel mounted to cover an opening created in a frame portion. The frame portion is constructed with a peripheral band portion connected to a plate like portion. A plurality of stiffening members are disposed to extend across the plate like portion. The door panel portion overlaps all sides of the opening. A plurality of hinges are disposed on one side of the door to attach it to the frame portion.

A peripheral gasket retainer and a peripheral L shaped portion cooperate to form a partially enclosed seal area. The peripheral gasket retainer is affixed to one of the door or frame portions adjacent the opening and the L shaped portion is affixed to the other.

A gasket has two extensive margins. One of the margins has a thick portion adjacent thereto which is configured to fit and remain within the retainer. The other margin is tapered to a radius and disposed to seat adjacent the corner of the L shaped portion. A strip like portion extends at a angle from the thick portion to the tapered portion and toward the corner of the L shaped portion, when the door is being closed.

A dogging mechanism comprises a plurality of lugs, each lug having a ramp portion and a plateau portion; a plurality of links pivoted mounted to cooperate with the lugs and a connecting bar pivotally connected to the links to form a parallel bar linkage. A roller is rotatably connected to each of the links and disposed to engage the ramp portion of the cooperatively associated lug and roll thereon and onto the plateau portion of the lug as the links are pivoted by the connecting bar. An operating handle is mounted for rotation with a link rigidly connected to the handle and an operating bar connects the operating handle link to the connecting bar to move the parallel bar linkage when the handle is turned and force the door into a water tight closed and sealed position irrespective of which side of the door is subjected to the higher pressure.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
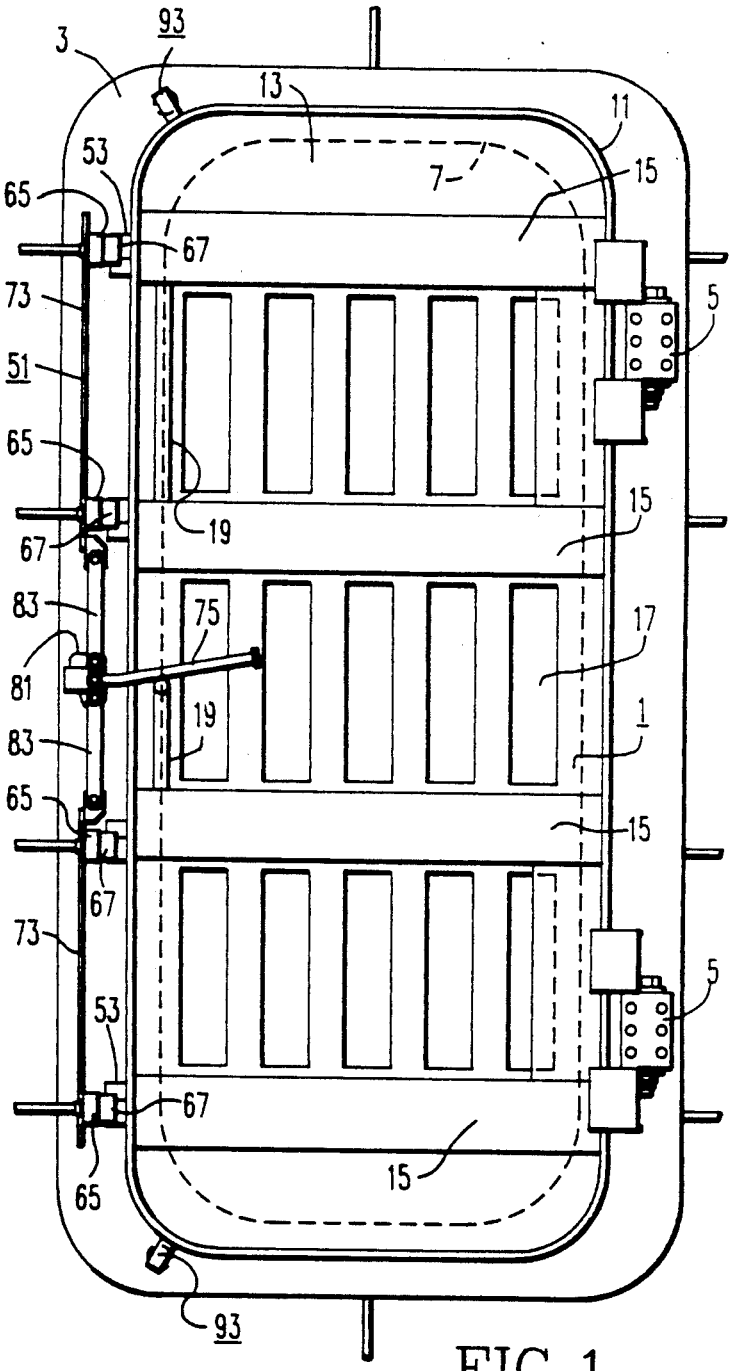
FIG. 1 is an elevational view of a door, frame and dogging mechanism.
Figure 3:
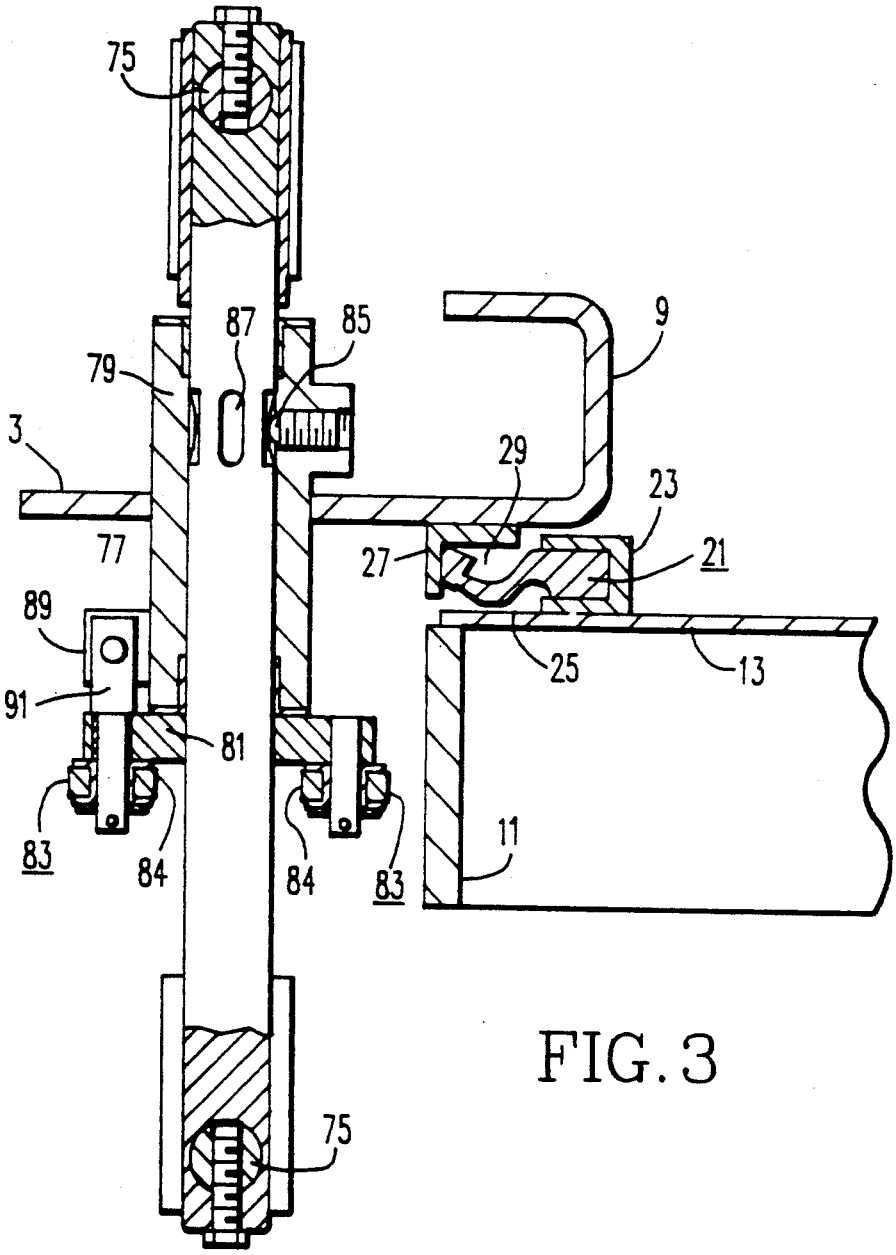
FIG. 3 is an enlarged partial sectional view of the door, frame, gasket and an operating handle.

Referring now to the drawings in detail and in particular to FIG. 1 there is shown a bulkhead door 1 for a ship prehung on a structure such as a frame 3 by a plurality of hinges 5 disposed on one side of the door 1. The frame 3 is a plate having a large central opening 7 with a C shaped cross section portion 9 disposed contiguous with the opening 7 to provide a stiff frame 3 with a opening having a rounded contour as shown in FIG. 3. The door 1 comprises a peripheral band portion 11 and a plate like portion 13 connected to the band portion 11 by welding or other means. A plurality of channel shaped stiffeners 15 extend across the door 1 from one side to the other and are attached to the band portion 11 and the plate like portion 13 by welding or other means. The plate like portion 13 has a plurality of elongated dimples 17 disposed between the stiffeners 15 to add additional stiffness to the door 1 without making the door 1 too heavy. Gripping handles 19 are disposed on both sides of the door to assist in opening and closing the door from either side.

As shown in FIGS. 3, 6, 7 and 8 a double directional gasket 21 is used to form a fluid seal between the frame 3 the door 1. The door 1 has a retainer portion such as a groove or U shaped member 23 disposed adjacent its periphery, the U shaped member 23 has an extended wall portion 25 formed by the plate like portion 13. The frame 3 has an L shaped portion 27 disposed adjacent its periphery, which cooperates with the U shaped portion 23 and extended wall portion 25 to form a partial enclosure 29 having a generally rectangular cross section.

Figure 8:
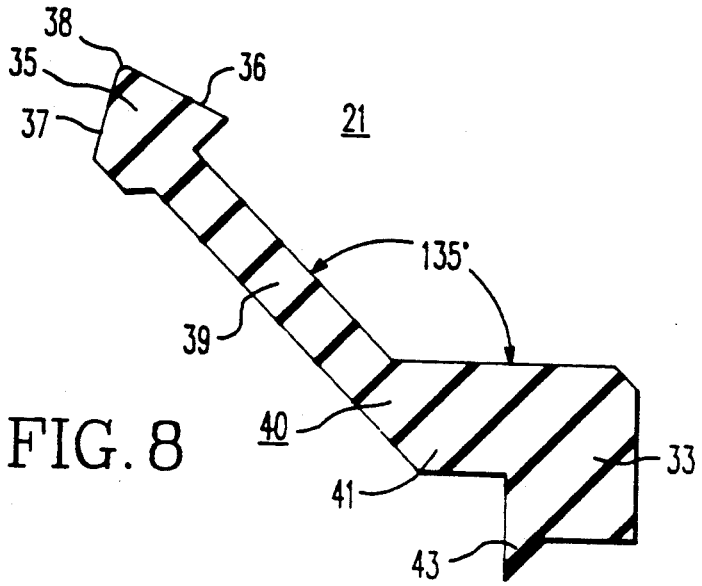
FIG. 8 is an enlarged sectional view of the gasket taken on lines 8—8 of FIG. 6.
Figure 6:
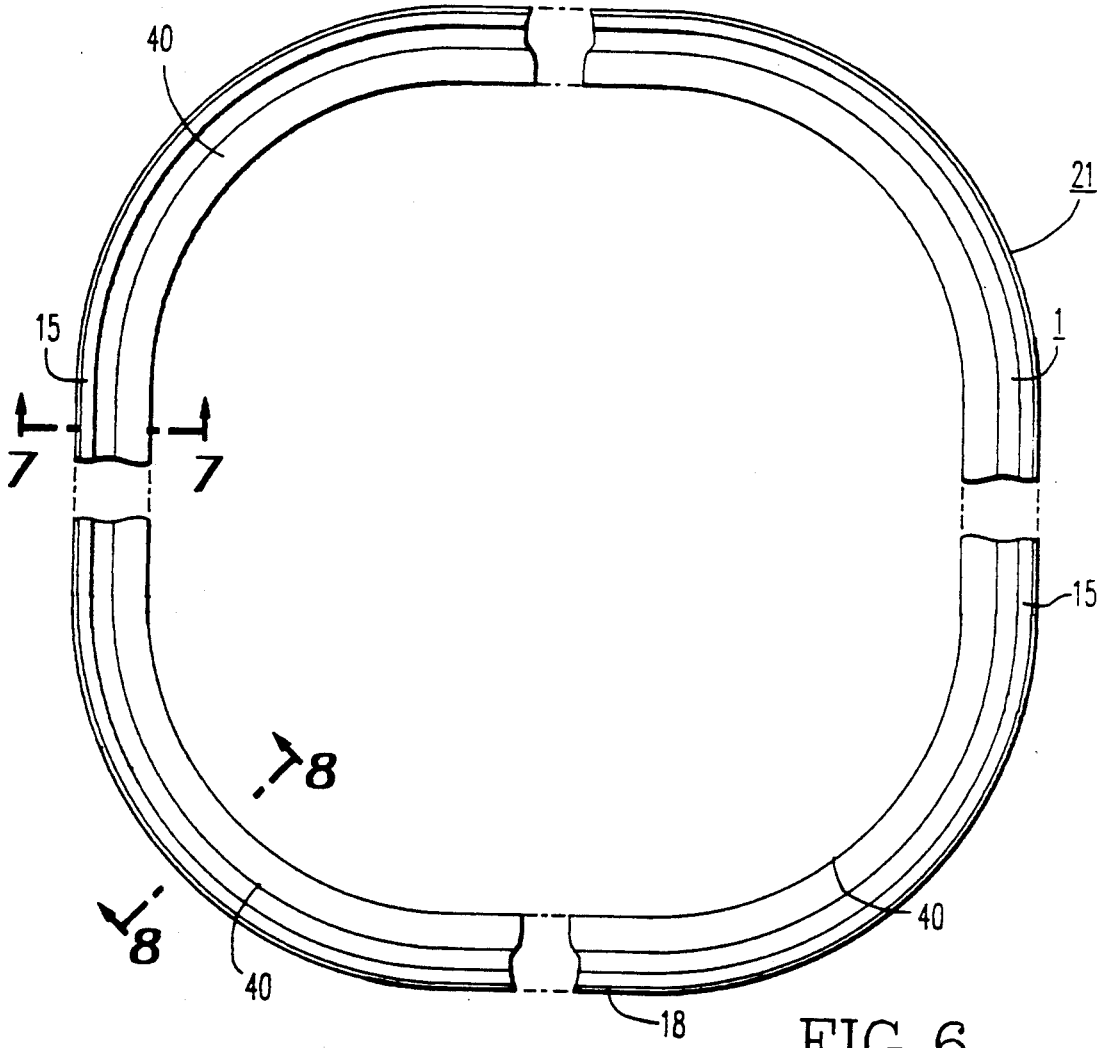
FIG. 6 is a plan view of the gasket.
Figure 7:
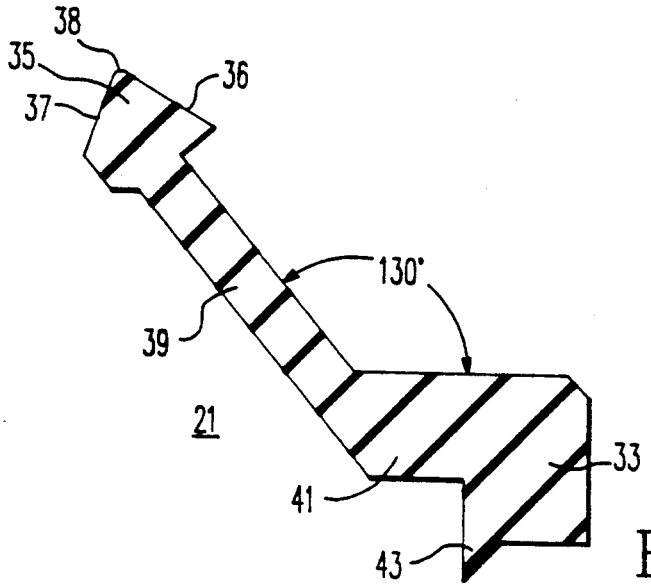
FIG. 7 is an enlarged sectional view of the gasket taken on lines 7—7 of FIG. 6.

The gasket 21, as shown in its free state in FIGS. 6, 7 and 8 comprises a continuous band having a pair of extensive margins. One of the margins has a thick portion 33 with a generally rectangular cross section adjacent thereto. The other margin has a cross section shaped generally like an arrowhead, this arrowhead shaped portion 35 has a pair of converging generally flat surfaces 36 and 37, which blend into an arcuate portion having a relatively small radius forming a tip 38. A strip portion 39 is disposed to extend between the thick portion 33 and arrowhead shaped portion 35 at an included angle of about 130° from the top surface of the thick portion 39 in the straight portions. Arcuate portions 40 of the gasket 21 generally have an included angle of 135°. These angles cooperate with the disposition of the enclosure portions to provide the proper contact between the tip 38 and a leg of the L shaped portion 27. Large hatches on commercial ships, which are opened and closed using a crane rather than being hinged, may require different angles and larger L shaped portions.

The thick portion 33 has an intermediate portion 41, which is not as thick as the portion adjacent the margin. The intermediate portion 41 is disposed adjacent the thin strip portion 39. The thick portion 33 of the gasket 21 also has a wedge shaped portion 43 forming the corner adjacent the intermediate portion 41. The thick portion 33 is slightly smaller than the opening in the U shaped member 23 allowing the thick portion 33 to be inserted into the U shaped member 23 when a reasonable insertion force is applied up to the point where the wedge shaped corner 43 contacts the U shaped member 23, at which time additional insertion force must be applied to deform the wedge shaped corner 43. The additional force deforms the wedge shaped corner 43 until the thick portion 33 is seated in the U shaped member 23. This deformation of the wedge shaped portion 43 forms a tight seal within the U shaped member 23 and acts to trap the thick portion 33 in the U shaped member 23. The intermediate portion 41 provides space for the deformation of the wedge shaped corner 43.

The angular orientation of the arrowhead portion 35 created by the strip portion 39 cooperates with the disposition of the L shaped portion 27 so that the tip 38 contacts the leg of the L shaped portion 27, which extends toward the thick portion 33, slides toward the corner formed by the juncture of the legs of the L shaped portion 27 and becomes trapped at the corner of the L shaped portion 27 as the door 1 continues to move toward the frame 3. The off center disposition of the tip 38 initiates bending of the strip portion 39 and cooperates with the intermediate portion 41 to cause the strip portion 39 to buckle and the flat surface. 37 of the arrowhead portion 35 to seat on the other leg portion of L shaped portion 27, when the U shaped member 23 with the extended portion 25 and L shaped portion 27 form the partial enclosure 29 under the continuing application of a minimal closing force. An S shaped cross section 45 of the strip portion 39 formed by the buckling produces a loading on the seating area generally 90° to the pressure loading on the strip portion 39. This loading tends to cancel a similar load applied by the gasket 21 on the opposite side of the enclosure 29 so that the net force applied by the gasket 21 is minimal. The S shaped cross section 45 of the strip portion 39 will react to pressure from either side to tighten the seal and find a good seat, even if some of the surface of the L shaped portion 27 is damaged. Increased pressure will create a tighter contact pressure between either of the flat surfaces 36 and 37 and the L shaped portion 27, depending on the direction in which the pressure is acting, thereby increasing the sealing action.

The enclosure 29 has a small gap 47 disposed between the L shaped portion 27 and the door 1. The gap 47 is smaller than the thickness of the arrowhead portion 35 so that when pressure is applied from the frame 3 side of the enclosure 29 and builds up to a certain level the arrowhead portion 35 moves across the gap 47 maintaining the seal and continues to do as the pressure continues to increase to a level where the gasket 21 fails due to tearing of the elastomer gasket material.

The enclosure also has a small gap 49 between the U shaped member 23, the L shaped portion 27 and the frame 3. When pressure is applied from the door side and reaches a certain level, the pressure attempts to push the strip portion 39 through the gap 49, to do so the strip portion 39 must fold and the folded strip portion is larger than the gap 49 so that under increased pressure the seal is maintained as the sealing action increases until the gasket 21 fails due to tearing of the elastomer gasket material.

As shown in FIGS. 1, 2, 3, 4, and 5, a dogging mechanism 51 for a closure such as a hatch or bulkhead door 1 on a ship comprises a plurality of lugs 53 preferably mounted on the peripheral band 11 of the door 1. The lugs 53 have a ramp portion 57 with a plurality of slopes 59 and 61 and a plateau portion 63. The slope portion 61 adjacent the plateau portion 63 is the least steep. Disposed to cooperate with each lug 53 is a pivotally mounted link 65. Each pivotally mounted link 65 has a roller 67 rotatably connected thereto on its distal end.

Figure 4:
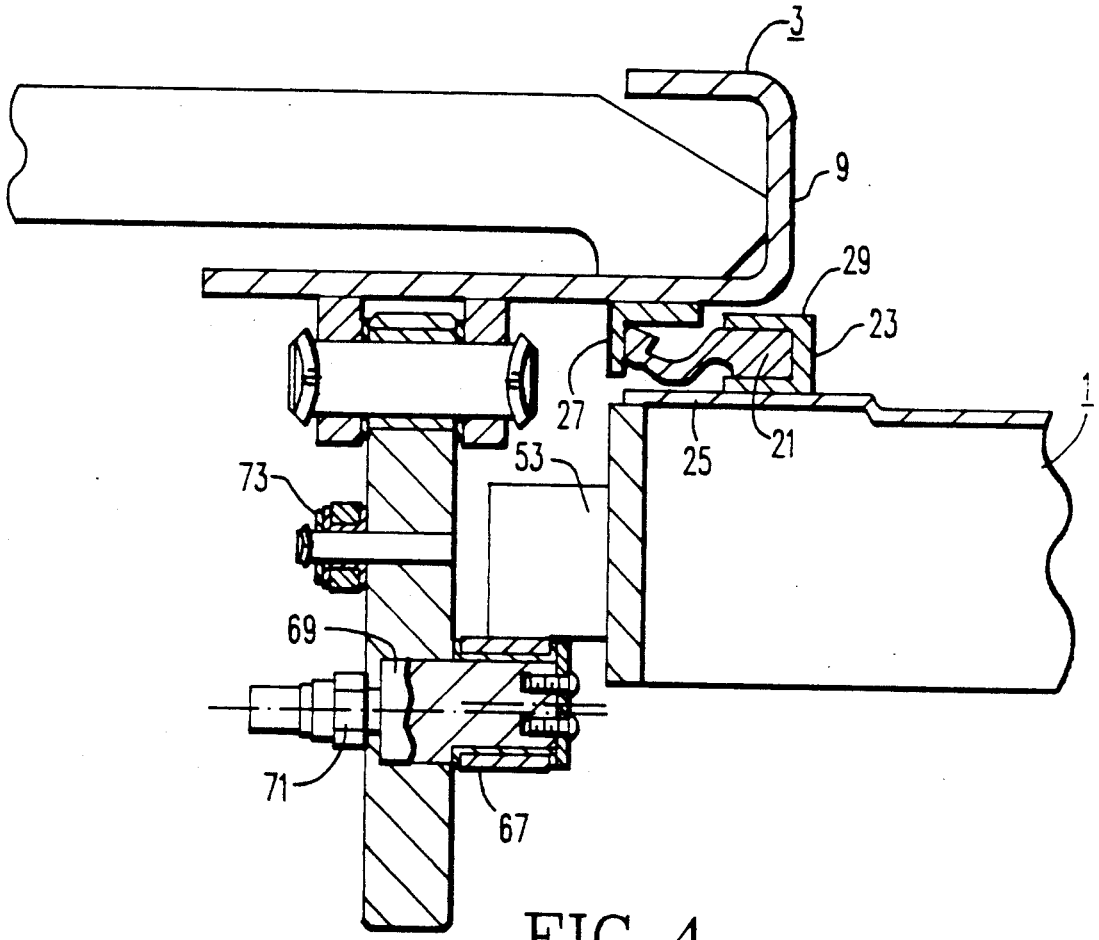
FIG. 4 is an enlarged partial sectional view of the door, frame, gasket, a lug, a roller and a pivoted link.
Figure 5:
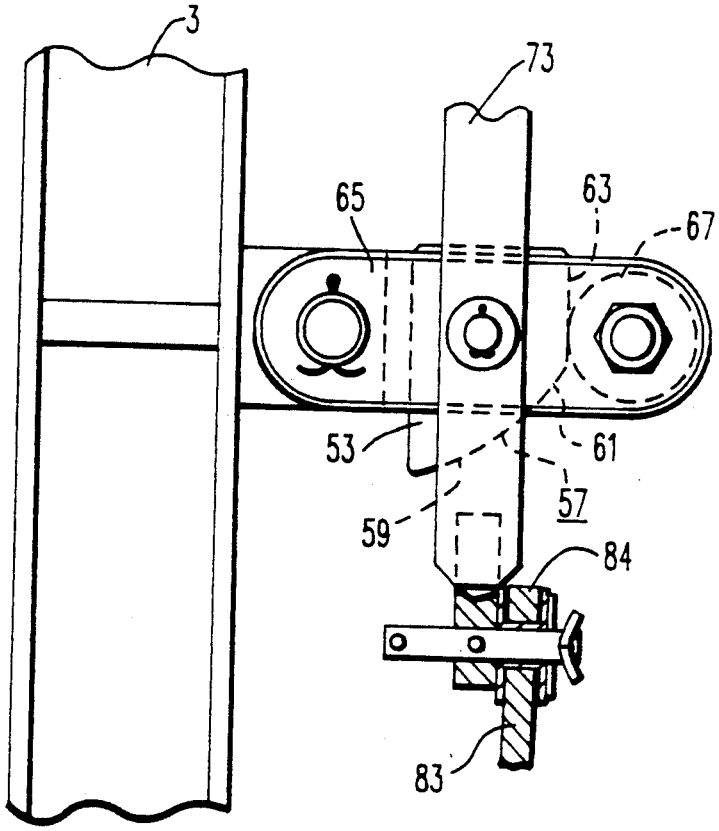
FIG. 5 is an enlarged partial elevational view of the frame, pivoted link, lug and a connecting bar and an operating bar.

As shown in FIG. 4, an eccentric shaft 69 connects the roller 67 to the pivotally mounted link 65. The amount of eccentricity is small and a locking nut 71 is provided to cooperate with the small eccentricity to prevent the eccentric shaft 69 from rotating once it is set. A connecting bar 73 pivotally connects at least two of the pivotally mounted links 65 inboard of the roller 67 to form a parallel bar linkage.

Figure 2:
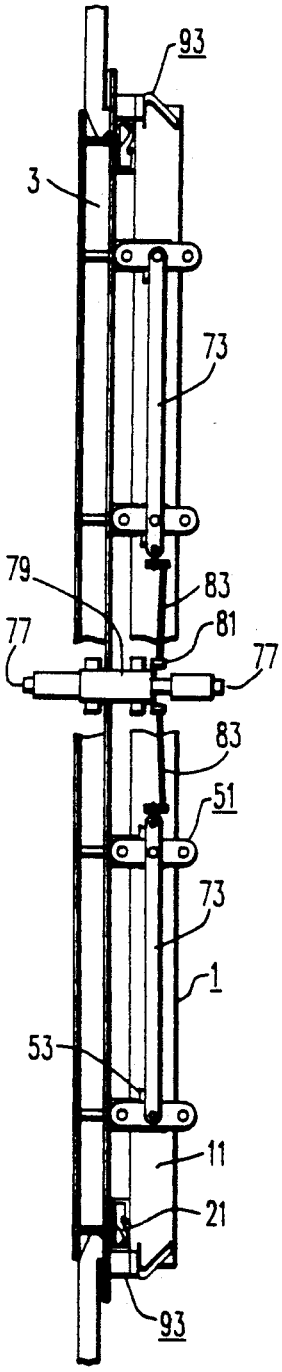
FIG. 2 is a side elevational view of the door, frame and dogging mechanism showing a gasket in section.

As shown best in FIGS. 2, and 3, an operating handle 75 is connected to both ends of a shaft 77, which is rotatably mounted in a bearing housing 79 to facilitate operating the dogging mechanism from either side of the door 1. A link 81 is rigidly connected to the shaft 77 and handle 75. An operating bar 83 having gimbal like ends 84 pivotally connects the link 81 to the connecting bar 73. The bearing housing 79 has spring loaded detent balls 85, which engage grooves 87 in the shaft 77 to position the handle 75 at two arcuate positions spaced 90° apart Adjustable stops 89 are disposed on the bearing housing 79 to engage a pin 91 on the link 81 to limit the rotation of the handle 75 to essentially 90°.

Figure 9:
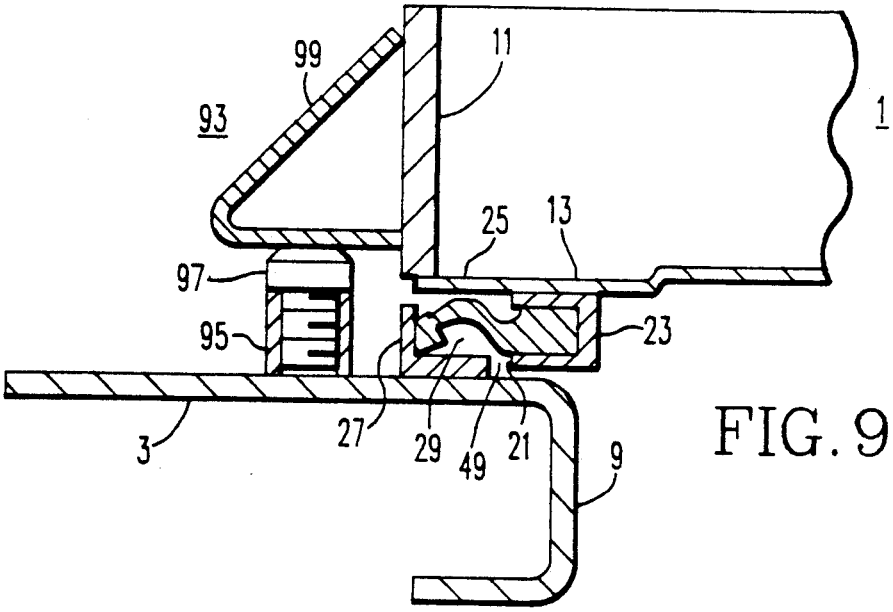
FIG. 9 is an enlarged sectional view of a bumper and rattle eliminator.

Bumpers and dampers 93 are disposed on the top and bottom of the door 1 to provide means for stopping the door when slammed and from rattling when closed and dogged as the gasket 21 does not provide sufficient force to stop the door from being moved by shipboard vibrations. Each bumper and damper 93, as shown in FIG. 9, comprises a cylindrical base portion 95 affixed to the frame 3 with a elastomer plastic button 97 inserted in the cylindrical base 95. A striker plate 99 is formed by a flat bar bent to produce an acute angle and welded to the peripheral door band 11 so that the button 97 strikes the striker plate 99 before there is metal to metal contact between the door 1 and frame 3. The door 1 bends well within its elastic limit and thus provides sufficient spring action when dogged to keep it against the bumpers 93.

Figure 10:
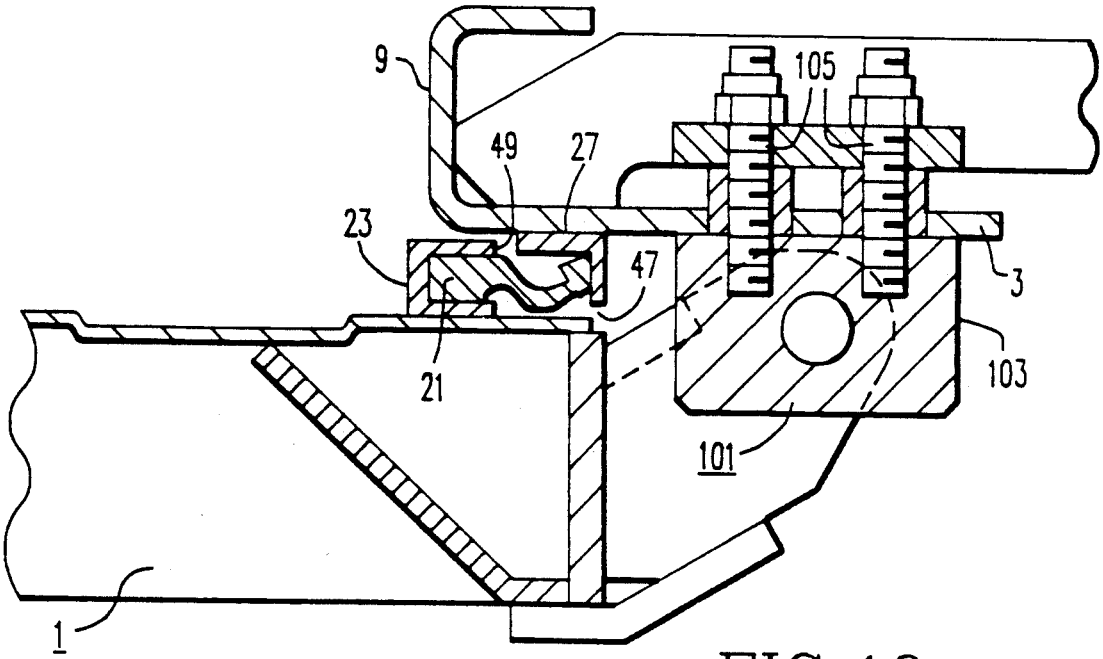
FIG. 10 is a sectional view of a hinge for the door.

A hinge 101 as shown in FIG. 10, is constructed with a fabricated box beam that is attached to the peripheral band 11 on the door 1. A hinge pivot block 103 uses bolted construction and is designed to allow a two dimensional adjustment of the door 1, about plus or minus 0.25" vertically or horizontally, without welding and locating the pivot point axis of rotation generally in line with the door panel or plate like portion 13 and cooperates with the dogging mechanism 51 so that the door panel or plate like portion 13 is generally parallel to the frame 3, when the door is dogged closed. Thus, providing an even sealing force on the gasket 21 and reducing the load required to close the door 1. The use of threaded hinge block studs 105, which protrude through the frame portion 3 and the ships bulkhead structure will make installation simpler because the door and hinge assembly can be initially attached to the bulkhead and then repositioned without being removed again. Also, a replacement door can be installed without welding. The stud tension load is high enough to prevent hinge sliding during shock loading or if a weight is hung on the door.

The operation of the dogging mechanism 51 to dog or latch the door 1, which has been closed by hand, begins by rotating the operating handle 75, whereby the links 81 push on the operating and connecting bars 83 and 73 to pivot the links 65. As the links 65 pivot, the rollers 67 engage the ramp portion 57 of the cooperatively associated lugs 53, rolling up the slopes 59 and 61 and on to the plateau portion 63 as the operating handle 75 approaches the closed position moving the door 1 in a tightly closed position to form a water tight seal when used with the double directional gasket 21. The rolling contact between the roller 67 and lug 53 together with the pivotal and rotational movements of the linkage reduces friction to a minimum so that the majority of the closing force is applied to close the door 1. When in the closed position, the link 65 and roller 67 are in a dead center position and any loading from the lugs 53 does not produce a force that would tend to operate the mechanism and at the same time the linkage is such that a force on the operating handle 75 transmits a maximum force through the mechanism 51 to either close or open the door 1 making the dogging mechanism 51 easy to operate. The simple toggle linkage at the operating handle 75 can be weight balanced to resist shock and keep the linkage in any position with out requiring high frictional loading.

To open the door 1, the operating handle 75 is turned in the opposite direction. The links 81 pull on the operating and connecting bars 83 and 73 to pivot the links 65 causing the rollers 65 to roll off the plateau portion 63 and on to the ramp portion 57 and 61 of the lugs 53 and then free of the lugs 53 allowing the door 1 to be swung open by hand.

The dogging mechanism 51 described herein is much simpler, less costly and weighs less than existing systems and yet can apply as much if not more load with out significant wear and with much less maintenance. The dogging mechanism 51 is easily maintained as there are few elements all of which are accessible and any portion can be removed without disturbing the other components. The light weight prehung door 1 and frame 3 cooperate with the double directional gasket 21 and dogging mechanism 51 to provide a bulk head door which is easy to install, is water tight in either direction, is easy to open, close and dog, and remains water tight when subjected to bulkhead warpage experienced by a ship at sea. The frame 3 with its C shaped portion and the plate like door with its stiffening band, channels and dimples has a high tolerance for the "potato-chip" type of deformation commonly occurring in bulkheads of ships at sea allowing the frame to move with the bulkhead and still maintain a water tight seal with the door.

While the preferred embodiments described herein set forth the best mode to practice this invention presently contemplated by the inventors, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A water tight door for an opening in a frame portion comprising a peripheral band portion, a plate like portion connected to the peripheral band portion, a plurality of stiffening members extending across said plate like portion, said door overlapping all sides of said opening, a plurality of hinges disposed on one side of said door attaching said door to said frame portion, a peripheral gasket retainer and a peripheral L shaped portion which cooperate to form a partially enclosed seal area, the peripheral gasket retainer being affixed to one of the door and frame portions adjacent the opening and the L shaped portion being affixed to the other; a gasket having two extensive margins one of said margins having a thick portion adjacent thereto, which is configured to fit and remain within said retainer, said other margin being tapered to a radius and disposed to seat adjacent the corner of said L shaped portion and a strip like portion extending at an angle from said thick portion to said tapered portion and toward the corner of said L shaped portion, when the door is being closed; a dogging mechanism comprising a plurality of lugs having a ramp portion and a plateau portion, a plurality of links pivoted mounted to cooperate with the lugs, a connecting bar pivotally connected to said links to form a parallel bar linkage, a roller rotatably connected to each of the links and disposed to engage the ramp portion of the cooperatively associated lug and roll thereon and onto the plateau portion of the lug as the links are pivoted by the connecting bar, an operating handle mounted for rotation with a link rigidly connected to said handle and an operating bar connecting the operating handle link to the connecting bar to move the parallel bar linkage when the handle is turned and force the door into a water tight closed position irrespective of which side of the door is subjected to the higher pressure.

2. The water tight door of claim 1, wherein the frame has a C shaped cross section contiguous with the opening.

3. The water tight door of claim 1, wherein the hinges and lugs are disposed adjacent a stiffening member which extend from a hinged side to an opposite side of the door.

4. The water tight door of claim 1, comprising means for preventing the door from rattling when closed and slamming metal to metal when being closed.

5. The water tight door of claim 1, wherein the operating handle and the parallel bar linkage are mounted on the frame and the lugs are mounted on the door.

6. The water tight door of claim 5, wherein the frame has stiffeners adjacent the hinges and the pivoted mounted links of the parallel bar linkage.

7. The water tight door of claim 1, wherein the plate like portion has a plurality of elongated dimples disposed between the stiffening members to further stiffen the door.

8. The water tight door of claim 1, comprising handles affixed to both sides of the door.

9. The water tight door of claim 1, wherein the hinges are so disposed that their rotational axis is generally in the plane of the door panel and cooperate with the dogging mechanism to position the door generally parallel to the frame when dogged closed.

10. A water tight door for an opening in a frame portion comprising an outer peripheral band portion, a single plate like portion connected to the outer peripheral band portion, said door overlapping all sides of said opening, a plurality of hinges disposed on one side of said door attaching said door to said frame portion, a peripheral gasket retainer and a peripheral L shaped portion which cooperate to form a partially enclosed seal area, the peripheral gasket retainer being affixed to one of the door and frame portions adjacent the opening and the L shaped portion being affixed to the other one of the door and frame portions, a gasket having two extensive margins one of said margins having a thick portion adjacent said margin, which is configured to fit and remain within said retainer at all times, said other margin being tapered to a radius and disposed to seat adjacent the corner of said L shaped portion and a strip like portion extending at an angle from said thick portion to said tapered portion and toward the corner of said L shaped portion, when the door is being closed, a dogging mechanism disposed on the side of said door opposite said hinges, a plurality of stiffening members extending across said plate like portion, from the peripheral band on one side of said door to the peripheral band on the other side of said door only adjacent said hinges and said dogging mechanism and a plurality of elongated dimples in said plate like portion disposed between said stiffening members.

* * * * *